United States Patent [19]

Porco

[11] Patent Number: 4,922,558

[45] Date of Patent: May 8, 1990

[54] HEADREST FOR USE IN BEAUTY SHOP SHAMPOO BOWLS, SINKS AND THE LIKE

[76] Inventor: Patricia A. Porco, 4922 N. Pearl St., Tacoma, Wash. 98407

[21] Appl. No.: 229,707

[22] Filed: Aug. 8, 1988

[51] Int. Cl.[5] ..... A45D 44/10

[52] U.S. Cl. ..... 4/523; 4/575; 4/621; 297/391; 5/437

[58] Field of Search ..... 4/515-523, 4/575, 621; 297/391; 5/434, 436, 437

[56] References Cited

U.S. PATENT DOCUMENTS

| | | | |
|---|---|---|---|
| 2,200,247 | 5/1940 | Haas | 4/575 |
| 2,461,744 | 2/1949 | Lafield | 5/436 X |
| 3,026,537 | 3/1962 | Schnell | 4/523 X |
| 4,063,318 | 12/1977 | Nicholson | 5/327 R |
| 4,352,216 | 10/1982 | Grim | 4/523 |
| 4,544,203 | 10/1985 | Younger et al. | 297/391 |
| 4,593,684 | 6/1986 | Graham | 128/75 |
| 4,641,883 | 2/1987 | Kato | 297/184 |
| 4,754,503 | 7/1988 | Martin | 4/517 |

FOREIGN PATENT DOCUMENTS

| | | | |
|---|---|---|---|
| 37751 | 9/1906 | Switzerland | 4/522 |

*Primary Examiner*—Henry J. Recla
*Assistant Examiner*—R. M. Fetsuga

[57] ABSTRACT

The present invention includes two frame members (10,12), each of which includes two elongated side legs (14,16) joined at the top by crossbars (20,21) and near the bottom by a cross piece (26). The two frame members (10,12) are rotatably connected to each other at approximately the center points of the side legs (14,16). A web-like support element (24) extends between the tops of the two frame members (10,12). Foot portions (E,E') are provided at the lower end of each side leg (14,16) and extend downwardly to a support surface. Suction cups (44) are positioned on the end of each side leg (14,16). The side legs (14,16) are configured and arranged such that the article angles forwardly when it is positioned on a horizontal surface, with the web-like support element (24) also being at an angle.

1 Claim, 2 Drawing Sheets

HEADREST FOR USE IN BEAUTY SHOP SHAMPOO BOWLS, SINKS AND THE LIKE

TECHNICAL FIELD

This invention relates generally to beauty shop accessories and more specifically concerns a headrest which is adapted to be used in a shampoo bowl or a sink or the like to support the head of a user during selected beauty shop procedures.

BACKGROUND ART

Beauty shops, some barber shops and certain other facilities specialize in the care of and treatment of hair. This typically includes such procedures as shampooing, dyeing or coloring, and permanents, among others. Such procedures are usually carried out by the operator when the customer is seated in a chair. Then the hair must be carefully rinsed to wash out all the chemicals from the customer's hair. During the rinsing process, the customer typically leans her/his head back over a sink or bowl and maintains it in that position for extended periods of time, i.e. 10 minutes, usually without substantial support. This frequently proves to be quite uncomfortable for the customer, depending on the length of time the customer must maintain her/his head in that awkward position.

Beauty shop operators have been aware of this particular problem and have looked for solutions. Articles for decreasing the discomfort of and supporting the head of the customer during such procedures are known. One example is shown in U.S. Pat. No. 3,026,537 to Schnell. Another example is shown in German Pat. No. 477,068. The articles shown in those patents, as well as others, however, have one or more disadvantages. Some of the articles, for instance, are not very effective in supporting the head of the customer, while others are cumbersome to use and still others are expensive to manufacture and therefor impractical.

Hence, there is a need for a simple, relatively inexpensive article which can be conveniently used to support the head of a customer during extended rinsing procedures and the like and which can be readily cleaned and conveniently stored when not in actual use.

DISCLOSURE OF THE INVENTION

Accordingly, the present invention includes a first frame-like member having two elongated side members, i.e. side legs, the side members being joined by top and bottom cross members, located generally at the top and bottom, respectively, of the side elements, one side element being shorter than the other. A second frame-like member is provided which is similar to the first frame-like member. The invention also includes means rotatably connecting the first and second frame-like members together approximately central of the elongated side elements in such a manner that the respective shorter side elements of each frame-like member are rotatably connected together and the other side elements are also rotatably connected together, such that when the article is supported on a horizontal surface, the article tilts in the direction of the shorter side elements. Further, the article includes a support element for a user's head which extends between the respective top cross elements of each frame-like member.

BEST MODE FOR CARRYING OUT THE INVENTION

Figure 1:
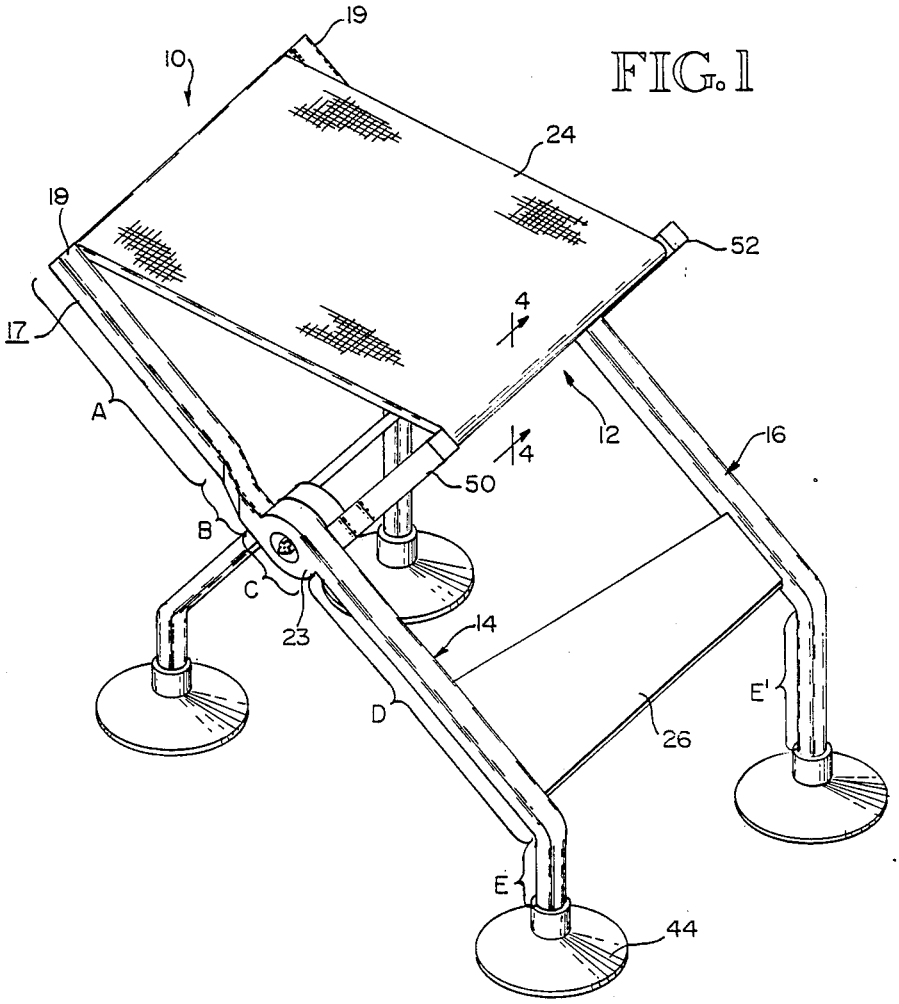
FIG. 1 is an isometric view of the hair care headrest of the present invention.
Figure 4:
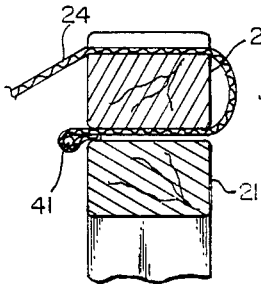
FIG. 4 is a cross-sectional view showing the structure for securing the head support element, i.e. the webbing, of the headrest of FIG. 1.
Figure 5:
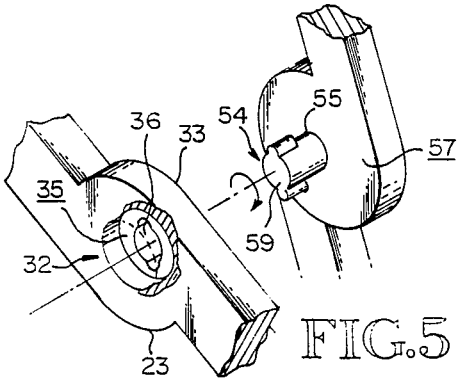
FIG. 5 is an isometric, partially cutaway view showing a portion of the headrest of FIG. 1.
Figure 2:
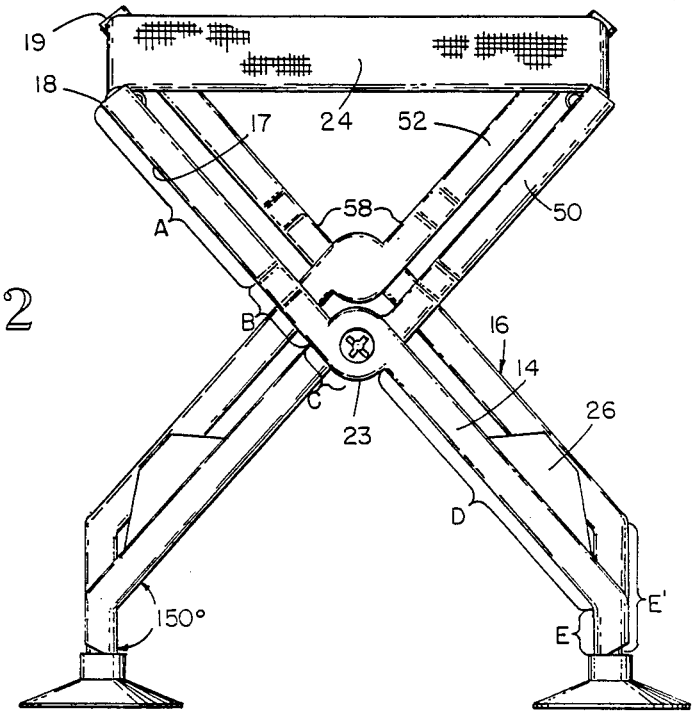
FIG. 2 is a front elevational view of the headrest of FIG. 1.

Referring to FIGS. 1 and 2, the headrest of the present invention includes two unitary frame members 10 and 12, rotatably connected together at approximately their respective midpoints, shown at 23 in FIG. 2. Frame member 10 includes two elongated side legs 14 and 16. In the embodiment shown, the side legs 14 and 16 are approximately $\frac{3}{8}$ inch wide by $\frac{1}{4}$ inch thick. Connecting the upper ends 18, 19 of side legs 14 and 16 are a pair of crossbars 20 and 21 (FIG. 4). Crossbars 20 and 21 are spaced slightly apart vertically to receive an end of a web-like head support element 24 which will be explained in more detail hereinafter. A cross piece 26 extends between the side legs 14 and 16 near the lower ends 28–28 thereof. In the embodiment shown, cross piece 26 is approximately $\frac{1}{8}$ inch thick and increases in width from $\frac{5}{8}$ inch to $1\frac{5}{8}$ inches from side leg 16 to side leg 14.

Side legs 14 and 16 are generally similar in configuration. Referring to side leg 14 as an example, the dimensions and configuration of leg 14 remain the same from the upper end 18 thereof for a distance of approximately $2\frac{3}{4}$ inches, shown as portion "A". At that point, side leg 14 angles outwardly for a distance of approximately $\frac{3}{8}$ of an inch, at which point the leg again extends in a direction parallel with the first portion "A" for a distance of approximately $\frac{1}{2}$ inch. This is shown as portion "B".

From portion "B", leg 14 includes a circular portion shown as "C", which is approximately central of the length of leg 14. In the embodiment shown, the lower edge 17 of portion A of leg 14 is tangent to the peripheral edge 23 of central portion C of the leg. Central portion C has a diameter of approximately $\frac{3}{4}$ inch and includes a shallow cavity 32 in the outer surface thereof. A small opening 36, resembling in outline a circle with two small ears extending from opposite sides thereof extends through central portion C from the lower surface 35 of the cavity 32 through to the inner surface of central portion C.

The next successive portion "D" of leg 14 extends away from central portion C parallel to portion A and in the same plane as portion B. The upper edge surface of portion D is tangent to the peripheral edge 23 of central portion C at a point 180° from the tangent portion B thereto. Portion D is similar in configuration to portion A but in the embodiment shown is approximately $2\frac{1}{2}$ inches long. Since portion D is coplanar with portion B, portion D is slightly offset laterally from portion A.

Figure 3:
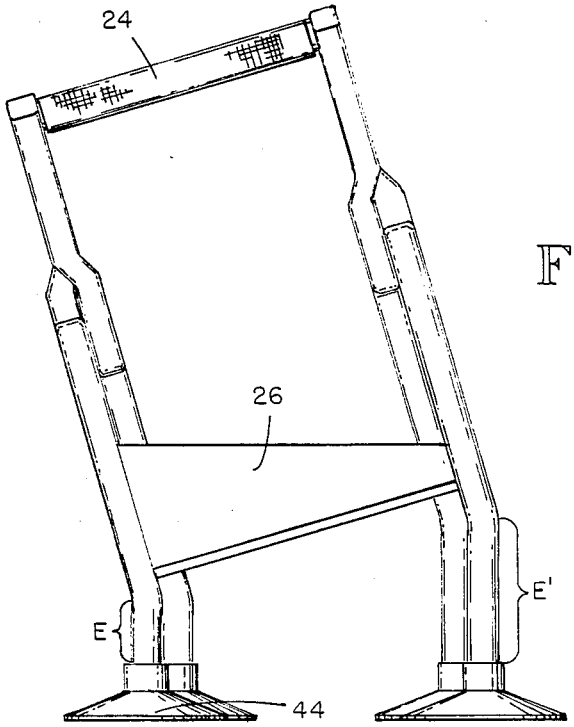
FIG. 3 is a side-elevational view of the headrest of FIG. 1.

Extending downwardly at an angle from portion D is portion "E", referred to as a foot portion. In the embodiment shown, the angle between portion E and portion D is approximately 150° (FIG. 2). Foot portion E is approximately 1 inch long. Secured in conventional fashion to the free end of foot portion E is a conventional suction cup member 44. There are a total of four suction cups for the headrest. The suction cups are conventional and in the embodiment shown have a diameter of 1¾ inches. Also as shown in FIG. 3, foot portion E is angled forwardly from the portion D of the leg as well, approximately 10° in the embodiment shown.

Side rail 16 is substantially identical to side rail 14, except that the foot portion E′ thereof is somewhat longer, i.e. approximately 2 inches in the embodiment shown. This results in crossbars 20, 21 sloping forwardly when the article is on a level surface.

The other frame member 12 is similar to frame member 10 as described above, with two significant exceptions. First, instead of the respective side legs being angled outwardly (portion B of side leg 14 for instance), the side legs of frame member 12 each angle inwardly over a portion of the length thereof such that the distance between side legs 50 and 52 of frame member 12 at the center thereof and below is approximately 3 ¼ inches, while the distance between side legs 14 and 16 of frame member 10 is approximately 3¾ inches. Hence, frame member 12 can fit between the side legs of frame member 10 in the vicinity of their respective central portions thereof and below.

Secondly, the outer surface of the central portion of each side rail 50 and 52 of frame member 12 includes a raised portion 54 (FIG. 4) which extends outwardly therefrom for approximately ¼ inch, i.e. approximately the thickness of the side legs of support member 10. This raised portion 54 has the same configuration at its free end as opening 36 in the central portion of side legs 14 and 16 of frame member 10, and is sized so that it fits through said opening 36. Between the outer surface 57 of the central portion of the side legs 50 and 52 and the free end of raised portion 54 is a cylindrical portion 55 which rotates in the mating portion of opening 36. This cylindrical portion is slightly longer than the thickness of the mating part of the central portions of side legs 14 and 16, i.e. the distance between inner surface 33 and the surface 35 of cavity 32. This arrangement holds the respective mating side rails of each frame member 10, 12 together in such a manner that the two frame members are held together but can rotate with respect to each other.

In one relative position, shown in FIG. 2, the respective frame members 10 and 12 form an X, with an angle 58 between their respective side legs of somewhat less than 90°. Rotating the two frame members 10, 12 toward each other decreases the angle to approximately 20° for convenient storage. Further decrease of the angle, typically requiring the application of some force, results in the raised portion 54 on the side legs 50, 52 of frame member 12 coming into registry with the matching opening 36 on the side legs of frame member 10 so that the two frame members can be separated from each other.

The web-like head support element 24 extends across the top of the head rest, with the respective ends thereof being held between the two crossbars 20 and 21 at the top of each frame member 10 and 12. In the embodiment shown, the head support element 24 comprises a loosely woven plastic web of a flexible material, such as Textilene, available from the Ludlow corporation. The weave is loose enough to permit liquid, including water and chemicals, from the rinsing or other process to drain through the webbing without collecting thereon. The head support element 24 in the embodiment shown is approximately 3½ inches wide, while the distance between the upper ends of the frame members 10 and 12 is approximately 5½ inches, when the article is in an operative position, such as shown in FIG. 2. These dimensions can of course be varied depending upon the actual configuration of the article. Each end of element 24 is doubled over around a small rod or the like 41 and then sewn. The resulting dimension of the respective ends of the element 24 are larger (thicker) than the opening between crossbars 20 and 21, resulting in the web-like element being held in place, as shown in FIG. 4.

In the embodiment shown, the overall height of the article at its front is approximately 7 inches, while the height at the back is approximately 8 inches. This is the result of the particular configuration discussed above of the side legs of each support member. The frame members 10 and 12 are typically made from a chemical resistant nylon material.

In use, the article is first opened so that the web-like head support element 24 is substantially horizontal, such as shown in FIG. 2. The article is then positioned in a sink or shampoo bowl and slight downward pressure is applied so that the suction cups on the lower ends of each leg become secured to the sink or shampoo bowl, thus providing a stable position for the article in the shampoo bowl. Wetting the suction cups will result typically in a firmer grip. Selected hair care procedures, such as shampooing or dyeing are then carried out, followed by the rinsing process, during which the customer positions her/his head directly on element 24 of the headrest, which supports the customer's head in a stable position. This is done even if the customer has rollers or other appliances in her hair. The customer is thus free to relax, because it is not necessary for her/-him to hold her/his head in a particular position, and the resulting discomfort is eliminated. When the article is not in use, it can be adjusted to a folded position and then stored.

Hence, a headrest has been developed which has a particular construction which is adapted for use in shampoo bowls, sinks and the like, during various hair care procedures, including particularly rinsing procedures in which hair treatment chemicals are washed from the hair. The headrest has a particular configuration and a specific arrangement of elements which makes it especially suitable for the described purposes.

Although a preferred embodiment of the invention has been disclosed herein for illustration, it should be understood that various changes, modifications and substitutions may be incorporated in such embodiment without departing from the spirit of the invention, which is defined by the claims which follow.

I claim:

1. A headrest, comprising:

a first frame-like member having two elongated side elements and top and bottom cross elements, wherein one side element is shorter than the other;

a second frame-like member similar to said first member;

means rotatably connecting the first and second frame-like members together approximately central of the elongated side elements thereof in such a manner that the respective shorter side elements of each frame-like member are rotatably connected together and the other side elements are also rotatably connected together, such that when the article is supported on a horizontal surface, the article tilts in the direction of the shorter side elements, wherein each side element of each frame-like member includes an upper portion, a lower portion and an intermediate central portion, the rotatable means being a part of said central portion, wherein the upper portions of the side elements of the first frame-like member are slightly outwardly offset from the lower and central portions thereof, wherein the upper portions of the side elements of said second frame-like member are slightly inwardly offset from the lower and central portions thereof, such that the respective central portions of the respective mating side elements of the first and second frame-like members are in registry substantially immediately adjacent each other, wherein the lower portions of each side element include foot portions which extend substantially vertically to a free end when the headrest is in an operative position supported on a horizontal surface, the article further including suction cups at the free end of each foot portion, wherein each foot portion has such a relationship to the remainder of the side element associated therewith that in the longitudinal plane, the foot portion extends downwardly from the lower portion of its associated side element at an angle approximately of 150° relative to the lower portion and in the lateral plane extends downwardly at an angle of approximately 10° from the lower portion of its associated side element; and support means for a user's head extending between the respective top cross elements of each of the frame-like members, wherein the support means is made from a web-like, water permeable material, such that any liquid applied to and draining from, the hair of the user will readily drain through such support means.

* * * * *